US005933688A

United States Patent [19]

Suzuki et al.

[11] Patent Number: 5,933,688

[45] Date of Patent: Aug. 3, 1999

[54] IMAGE FORMING APPARATUS INCLUDING SWITCHING STRUCTURE FOR SEPARATING A PHOTOSENSITIVE DRUM AND A DEVELOPING ROLLER AFTER COMPLETION OF PRINTING

[75] Inventors: Tsutomu Suzuki, Nagoya; Hideo Yoshihara, Toki, both of Japan

[73] Assignee: Brother Kogyo Kabushiki Kaisha, Nagoya, Japan

[21] Appl. No.: 09/089,519

[22] Filed: Jun. 3, 1998

[30] Foreign Application Priority Data

Jun. 5, 1997 [JP] Japan ..... 9-147616
Nov. 26, 1997 [JP] Japan ..... 9-324491

[51] Int. Cl.[6] ..... G03G 15/00

[52] U.S. Cl. ..... 399/222; 399/119

[58] Field of Search ..... 399/119, 222, 399/228, 234, 252, 236, 226, 277, 75, 279

[56] References Cited

U.S. PATENT DOCUMENTS 4,891,674 1/1990 Seyfried .

FOREIGN PATENT DOCUMENTS 1-6985 1/1989 Japan .
A-2-37380 2/1990 Japan .

*Primary Examiner*—Joan Pendegrass
*Attorney, Agent, or Firm*—Oliff & Berridge, PLC

[57] ABSTRACT

A photosensitive drum 25 is rotated counterclockwise by a predetermined angle upon completion of printing. A release belt 44 is caused to rotate in the same direction by surface friction between a nip release belt 49 and a surface of the photosensitive drum 25. At this time, a pitch roller 47 provided at both ends of a developing roller 27 is rotated clockwise while guided along a roller guide hole 61 of the release belt 44, runs onto an upper plane of the nip release belt 49, and releases the developing roller 27 from the photosensitive drum 25 with a clearance which is substantially equal to the thickness of the nip release belt 49.

22 Claims, 10 Drawing Sheets

IMAGE FORMING APPARATUS INCLUDING SWITCHING STRUCTURE FOR SEPARATING A PHOTOSENSITIVE DRUM AND A DEVELOPING ROLLER AFTER COMPLETION OF PRINTING

BACKGROUND OF THE INVENTION

1. Field of the Invention

The present invention relates to an image forming apparatus such as a laser printer and the like, which forms an electrostatic latent image on an image bearing member, or a photosensitive drum and supplies toner materials onto the electrostatic latent image through a developing roller in contact under pressure with the photosensitive drum to develop the image, and more particularly, to an image forming apparatus in which the developing roller can be released from the photosensitive drum after completion of image formation to achieve the printed images with high quality.

2. Description of Related Art

In conventional image forming apparatus such as a laser printer, generally, the surface of a photosensitive drum is charged uniformly by a scorotron type charger and the like and irradiated by an exposure device such as a laser beam scanner which projects a light image corresponding to an output image, thus forming an electrostatic latent image thereon. A developing roller supplies toner to the electrostatic latent image on the photosensitive drum to form a toner image. Then, the toner image is transferred onto a sheet of paper. This paper is heated by a fusing device that fuses the toner to form a printed image on the paper.

Such the image forming apparatus has the following disadvantages; when the photosensitive drum and the developing roller are kept in contact with each other for a long time after completion of printing, the substance extracted from a conductive rubber member defining the surface of the developing roller may stick to the surface of the photosensitive drum, resulting in the chemical deterioration of the photosensitive drum surface and the generation of strip-like stains (referred to as drum stains, hereinafter) which will deteriorate a printing quality.

To avoid the above disadvantages, there have been proposed various types of image forming apparatus. For example, Japanese Patent unexamined publication No. 2-37380, which has claimed priority from U.S. Pat. No. 4,891,674, discloses a development apparatus for use in an electrophotographic printing machine in which an applicator roller that has developer material adhering releasably to a surface thereof is mounted rotatably in a housing chamber, and racks are provided at an interval on the external surface of the side wall of the housing. The racks are engaged with pinion gears. Extension coil springs are mounted between the housing and a frame of the apparatus. When the applicator roller is driven by a motor to rotate in one direction, a rotation torque is transmitted to a constant torque slip clutch mounted on a shaft of the pinion gears. The housing is lifted up to the height against a constant load of the extension springs as the applicator roller is rotated, so that the applicator roller comes into contact under pressure to a photoconductive belt, operating to develop an electrostatic latent image. When the motor is de-energized, the housing is moved downward by the force of the extension springs exerting on the housing through the racks and pinions, bringing the applicator roller to a position spaced from the photoconductive belt. Thus, the photosensitive drum and the applicator roller can be supported spaced from each other after completion of printing.

However, the above conventional development apparatus is designed so that the housing is moved upward or downward to cause the applicator roller to come into contact with or become apart from the photoconductive belt. For the purpose, the gears which couple the applicator roller shaft to the pinion gear shaft, the constant torque slip clutch, the pinion gears, and the racks are used for a mechanism to transmit the power from the applicator roller to the housing. In addition, the extension coil spring is used to urge the housing to move in one direction. Accordingly, the mechanism to cause the applicator roller to come into contact with or be separated from the photoconductive belt is very large-sized, complex, and large in the number of components, resulting in an increase in cost.

SUMMARY OF THE INVENTION

The present invention has been made in view of the above circumstances and has an object to overcome the above problems and to provide a compact image forming apparatus with a simple and inexpensive mechanism for separating a photosensitive drum and a developing roller from each other, without the use of conventional racks and pinion gears and others, by a reverse rotation of at least one of the photosensitive drum and the developing roller after completion of printing to surely prevent drum stains.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, there is provided an image forming apparatus for performing image formation using an electrophotographic process, the apparatus having a cylindrical photosensitive drum on which an electrostatic latent image is to be formed and a developing roller which supplies developer material to the latent image formed on the photosensitive drum to develop it, the developing roller being disposed opposite to the photosensitive drum, the apparatus comprising switching means for switching the photosensitive drum and the developing roller from a first position where they are in contact with each other to a second position where they are separated from each other in cooperation with rotation of at least one of the photosensitive drum and the developing roller, after completion of printing, in a second rotating direction which is opposite to a first rotating direction in which at least one of the photosensitive drum and the developing roller is rotated during printing.

In the above image forming apparatus, when at least one of the photosensitive drum and the developing roller is rotated in the second direction, which is reverse to the first direction in which they are rotated in printing, upon completion of printing, the switching means switches the photosensitive drum and the developing roller from a contact (first) to a release (second) positions. Accordingly, the switching means in cooperation with the reverse rotation of at least one of the photosensitive drum and the developing roller after printing can surely separate the photosensitive drum and the developing roller to avoid the generation of drum stains caused by a contact state of the photosensitive drum and the developing roller maintained for a long time after printing.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 7(*b*) is an enlarged sectional partial view showing a rotating state of both the photosensitive drum and the developing roller during printing;

FIG. 7(*c*) is an enlarged sectional partial view showing a reverse rotating state of the photosensitive drum and the pitch cam after completion of printing;

FIG. 7(*d*) is an enlarged sectional partial view showing a release state of the developing roller from the photosensitive drum after completion of printing;

FIG. 9(*b*) is an enlarged sectional partial view showing a rotating state of both a photosensitive drum and a developing roller during printing;

FIG. 9(*c*) is an enlarged sectional partial view showing a reversely rotating state of the pitch cam after completion of printing;

FIG. 9(*d*) is an enlarged sectional partial view showing a released state of the developing roller from the photosensitive drum after completion of printing;

FIG. 10(*b*) is an enlarged sectional partial view showing a rotating state of both the photosensitive drum and the developing roller during printing;

FIG. 10(*c*) is an enlarged sectional partial view showing a reverse rotating state of the sliding contact member and the pitch cam after completion of printing;

FIG. 10(*d*) is an enlarged sectional partial view showing a release state of the developing roller from the photosensitive drum after completion of printing.

DETAILED DESCRIPTION OF THE PREFERRED EMBODIMENTS

A detailed description of preferred embodiments of an image forming apparatus embodying the present invention will now be given referring to the accompanying drawings.

Figure 1:
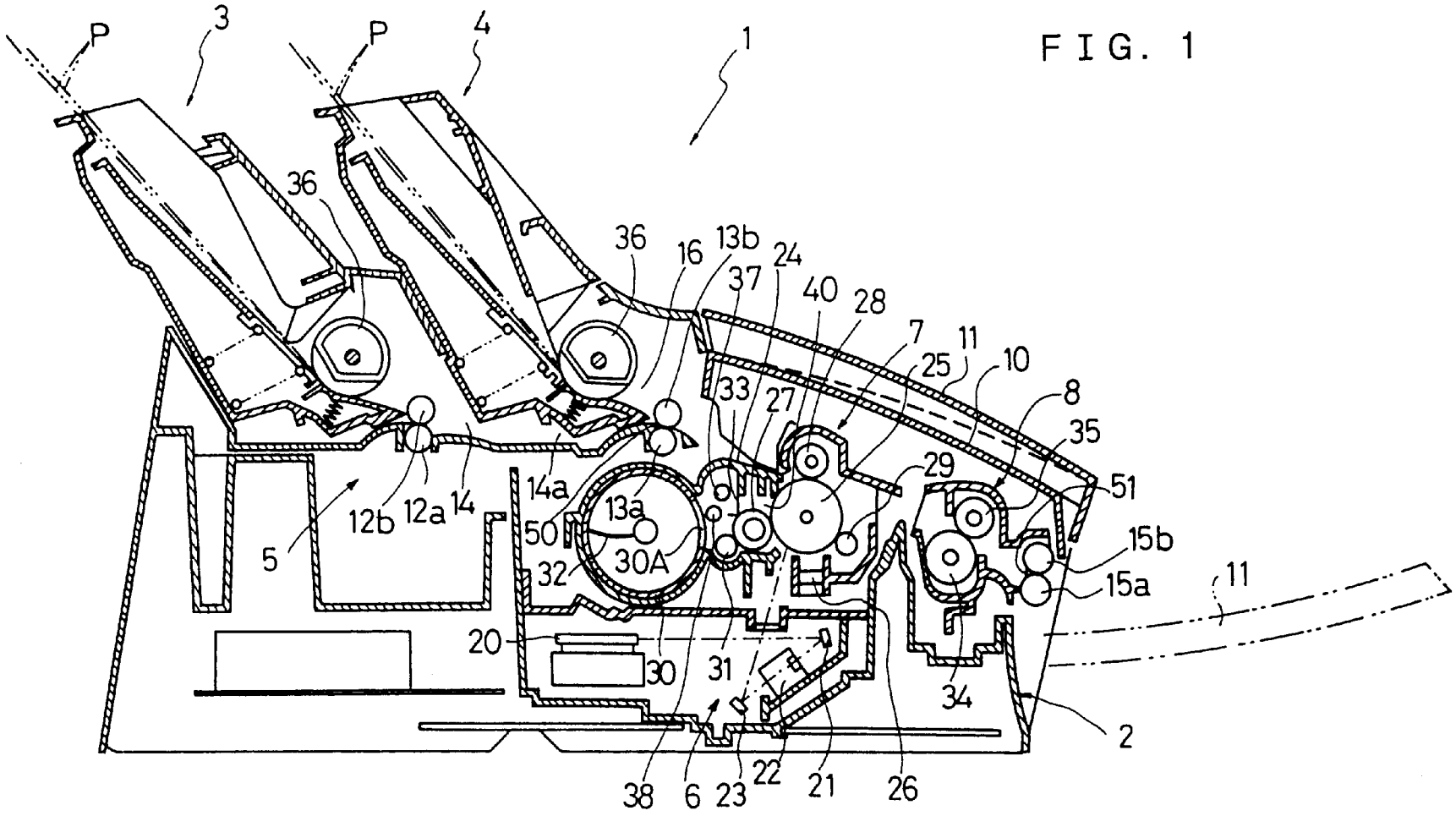
FIG. 1 is a sectional side view of a laser printer in the first embodiment according to the present invention.

First, a schematic structure of the laser printer in the first embodiment will be explained with reference to FIG. 1. FIG. 1 is a sectional side view of the laser printer.

In FIG. 1, the laser printer 1 is provided with a main frame 2, a first paper tray 3 and a second paper tray 4 both provided on an upper surface of a rear end side of the main frame 2, a paper feeding mechanism 5 provided in the main frame 2, a scanner unit 6, a process unit 7, a fixing unit 8, and driving units for driving the first and second paper trays 3 and 4, the paper feeding mechanism 5 and others. Those driving units, not illustrated, are disposed on a left side in the main frame 2. Provided on a front side upper portion of the main frame 2 are a top cover 10 which can be opened above a printing mechanism and a paper discharge tray 11. This paper discharge tray 11 can switch its position between a closed position and an open position, acting as a tray for receiving printed paper P at the open position.

Here, the scanner unit 6, the process unit 7, and the fixing unit 8 and others constitute the printing mechanism. The process unit 7 is provided with a photosensitive drum 25 functioning as an image bearing member, a charger 26, a developing roller 27, a transfer roller 28, a cleaning roller 29, and others, which are being housed in a casing 24. The process unit 7 is formed as a cartridge structure so as to be detachably set in a predetermined position of the main frame 2.

The first paper tray 3 is fixedly provided on an upper side close to the rear end of the main frame 2. The second paper tray 4 is provided detachably from an upper side of the main frame 2, ahead of the first paper tray 3. The paper feeding mechanism 5 serves for feeding individual paper P selectively supplied from the first and second paper trays 3 and 4 to the process unit 7. The paper feeding mechanism 5 has a pair of feed rollers 12*a* and 12*b* disposed downstream of the first paper tray 3 and a pair of resist rollers 13*a* and 13*b* disposed downstream of the second paper tray 4. The feed roller 12*a* is a driving roller and the feed roller 12*b* is a sub-roller. The resist roller 13*a* is a driving roller and the resist roller 13*b* is a sub-roller. A paper feed path 14 from the first paper tray 13 to the resist rollers 13*a* and 13*b* includes a lower side feed path 14*a* extending along a lower surface of the second paper tray 4. The lower side feed path 14*a* will be opened to the outside when the second paper tray 4 is detached from the main frame 2.

The paper P supplied through a pick-up roller 36 from the first paper tray 3 is transported by the feed rollers 12*a* and 12*b* along the lower side feed path 14*a* to the resist rollers 13*a* and 13*b* which provide resistance to the paper, and then the paper P is transported to the process unit 7. The paper P supplied through another pick-up roller 36 from the second supply tray 4 is transported to the resist rollers 13*a* and 13*b* which provide resistance to the paper P, and transported to the process unit 7.

The scanner unit 6 is disposed under the process unit 7 and includes a laser emitting portion not shown, a polygon mirror 20, reflection mirrors 21 and 24, and a plurality of lenses 22, etc. A laser beam emitted from the laser emitting portion is directed, along a chain line in FIG. 1, via the polygon mirror 20, the reflection mirror 21, the lens 22, and the reflection mirror 23 toward the process unit 7. In the process unit 7, the laser beam irradiates at a high speed scan a charged circumferential outer surface of the photosensitive drum 25 in rotation, exposing it, to form an electrostatic latent image on the surface of the photosensitive drum 25.

The process unit 7 accommodates, in the casing 24, the photosensitive drum 25, the scorotron type charger 26, the developing roller 27, the transfer roller 28, the cleaning roller 29, a toner cartridge 30, and the toner supply roller 31. Developer material, or toner material is supplemented by attachment of the toner box 30 into the casing 24 of the process unit 7 after detached from the main frame 2.

Toner in a toner container 54 of the toner cartridge 30 is agitated by an agitator 32, flicked through a port 30A, and supplied to the developing roller 27 through the toner supply roller 31. The toner is carried on the developing roller 27, forming a toner layer with a predetermined thickness regulated by a blade 33, and is supplied to the photosensitive drum 25. Two auger members 37 and 38 are provided in the vicinity of the opening 30A of the toner box 30. Each of the auger member 37 and 38 operates for uniformly dispersing the toner flicked through the ports 30A in the casing 24.

The developing roller 27 provides the toner to the electrostatic latent image formed on the surface of the photosensitive drum 25 to visualize the electrostatic latent image. The image is transferred onto the paper P passing between the photosensitive drum 25 and the transfer roller 28 and is fused to be fixed on the paper in the fixing unit 8. The residual toner remaining on the surface of the photosensitive drum 25 is once collected by the cleaning roller 29 and then is collected through the photosensitive drum 25 to the developing roller 27 at a predetermined timing.

The fixing unit 8 which fixes fusing toner on the paper P has a heat roller 34, a pressure roller 35 which is in contact under pressure with the heat roller 34, a pair of discharge rollers 15*a* and 15*b* for discharging the paper P to the outside of the main frame 2. The discharge rollers 15*a* and 15*b* are disposed downstream of the rollers 34 and 35. A sensor 51 is provided in the vicinity of the almost axially center of the discharge roller 15*a* to detect the discharge of the paper P to the outside.

The feed speed (the first feed speed) at which the paper P is fed by the photosensitive drum 25 and the transfer roller 28 in the process unit 7 is set to be equal with or larger than the feed speed (the second feed speed) at which the paper P is fed through the heat roller 34, the pressure roller 35, and the discharge rollers 15*a* and 15*b*, in turn, in the fixing unit 8. This is because there is a possibility that the second feed speed larger than the first feed speed causes pulling of the paper P at a nip point between the photosensitive drum 25 and the transfer roller 28, which may result in positional displacement of the output image to be formed on the paper P when the toner image formed on the photosensitive drum 25 is transferred to the paper P, thus causing blur of the visual image.

Figure 2:
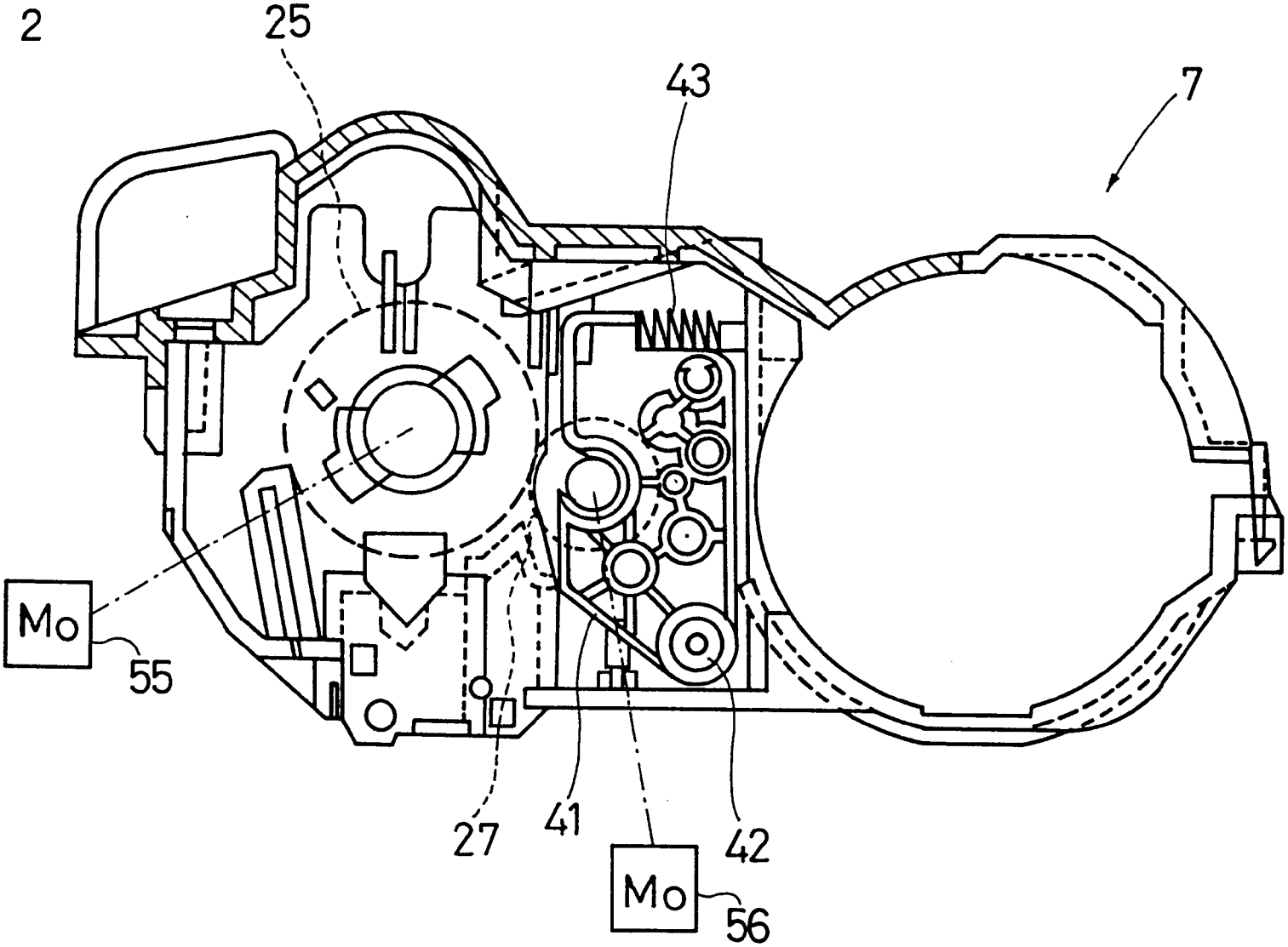
FIG. 2 is an enlarged side view of a process unit of the laser printer.

Next, a mechanism for making the developing roller 27 come into contact under pressure to the photosensitive drum 25 is described with reference to FIG. 2. This mechanism corresponds to a supporting means. FIG. 2 is an enlarged sectional side view of the process unit 7, which is seen from the back side of FIG. 1. In FIG. 2, the photosensitive drum 25 is rotatably disposed in the process unit 7 and can be rotated by a motor 55 for photosensitive drum through gears and the like. The developing roller 27 is rotatably held by a pair of swing arms 41 supporting both ends of a shaft of the developing roller 27. The developing roller 27 can be rotated by a motor 56 for developing roller through gears. Each of the swing arms 41 is supported rotatably about a rotation fulcrum 42 while a compressive spring 43 attached to a frame of the process unit 7 applies rotating torque to the swing arm 41 in the direction toward the photosensitive drum 25 side (counterclockwise in FIG. 2). Accordingly, the developing roller 27 is held against the photosensitive drum 25 with a predetermined load by the compressive spring 43 through the swing arm 41.

Figure 3:
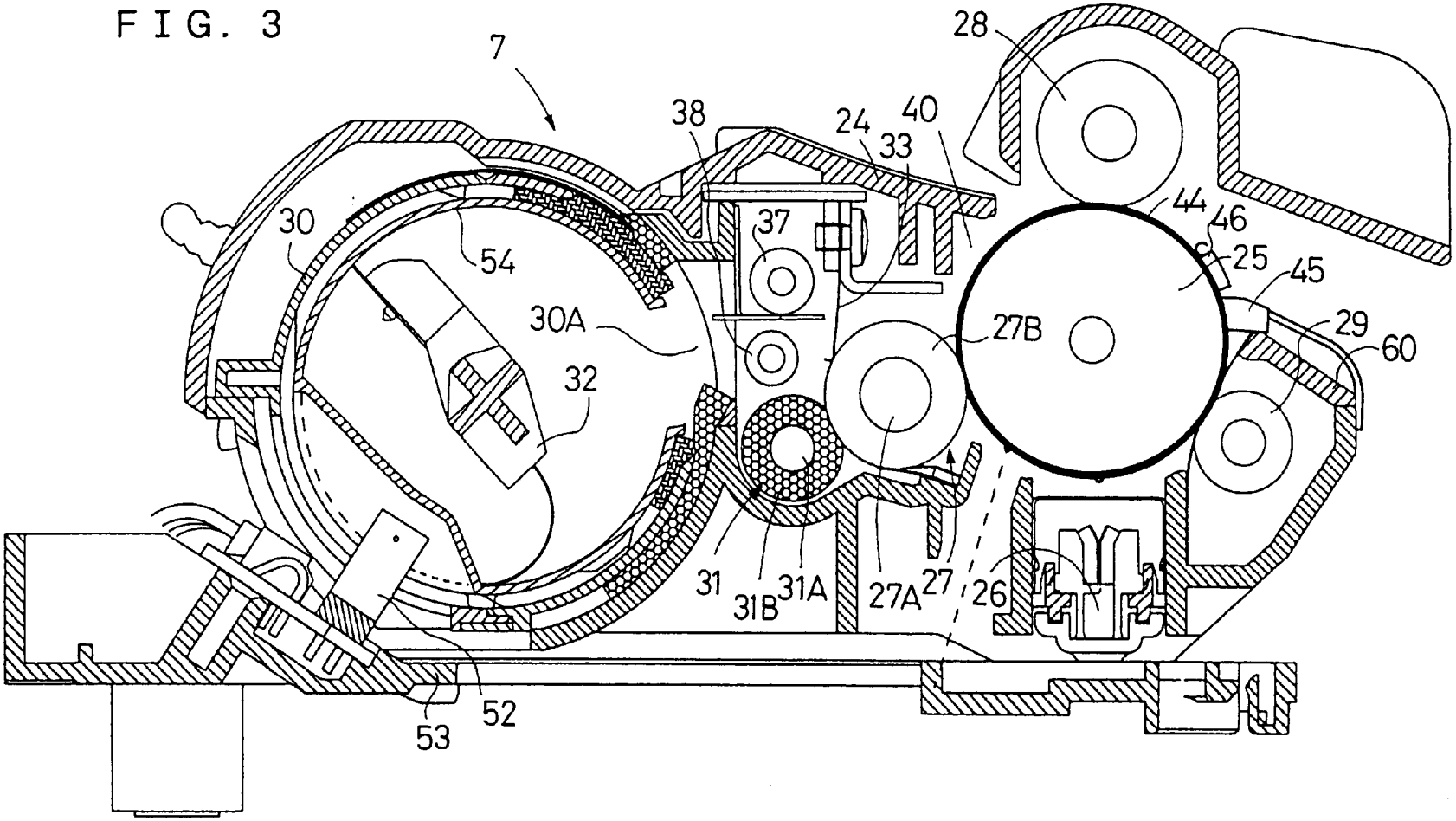
FIG. 3 is a further enlarged side view of the process unit.
Figure 4:
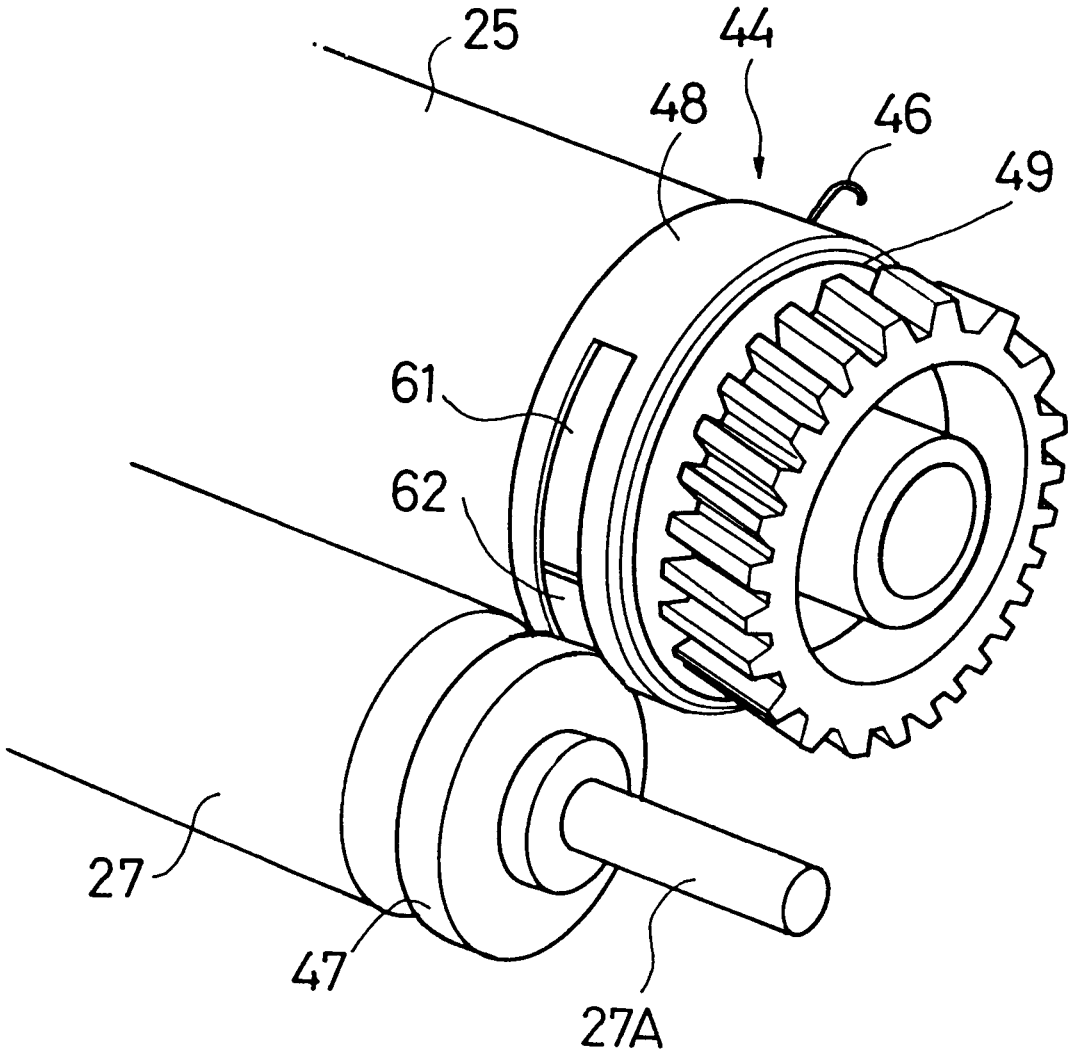
FIG. 4 is a perspective view each part of a photosensitive drum having a release belt thereon and a developing roller having a pitch roller in the first embodiment.

Next, explanation is made on the structure of the process unit 7, referring to FIGS. 3 and 4. FIG. 3 is an enlarged sectional side view of the process unit 7 during a printing operation. FIG. 4 is an enlarged perspective view of a part of the photosensitive drum 25 having a release belt wound thereon and a part of the developing roller 27 having a pitch roller engaging with a nip concave of the release belt.

In FIG. 3, the toner supply roller 31 is disposed rotatably with respect to the developing chamber 40. The developing roller 27 is disposed rotatably and opposite to the toner supply roller 31. This toner supply roller 31 supplies the toner provided through the toner supply port 30A to the developing roller 27. Here, the toner supply roller 31 has a roller shaft 31*a* made of metal -which is selected from, for instance, various steel materials- and a conductive sponge member 31B which covers the periphery of the roller shaft 31A. The developing roller 27 has a roller shaft 27A made of metal -which is selected from, for instance, various steel materials- and a conductive rubber member 27B. This conductive rubber member 27B is generally harder than the conductive sponge member 31B and covers the periphery of the roller shaft 27A. Accordingly, during toner supply from the toner supply roller 31 to the developing roller 27, the conductive sponge member 31B of the toner supply roller 31 is supported in a slightly compressed state by contact with the conductive rubber member 27B of the developing roller 27.

A toner sensor 52 for detecting the amount of toner in the toner container 54 which has been soldered on a circuit board is tightened on a scanner cover 53, below a substantial center of the toner box 30 (at the lower left side in FIG. 3). The toner sensor 52, formed of an LED and a photosensor, detects the amount of light transmitting in the lower part of the toner container 54 interposed between the LED and the photosensor, namely, the existence of toner therein.

A pair of pitch rollers 47 (a second positioning part) are mounted rotatably on both ends of the developing roller 27 as shown in FIG. 4. The pitch roller 47 is made of synthetic resin, for example, urethane resin. A pair of release belts 44 (a first positioning part) are wound around the photosensitive drum 25, at its both ends opposite to the pitch roller 47, so as to be slidable thereon in tension with a tension spring 46 (an elastic member) and form a first and a second concaves which will act for a first and a second operating sections. An end portion (a back stop member) of the release belt 44 on an end side in a regular rotating direction, which is a rotating direction of the photosensitive drum in printing, is adhered as bent in a curve on a casing 60 (a contact member) with an adhesive (see FIG. 5). A stopper 45 acting as a whirl-stop is in contact with the casing 60.

Figure 5:
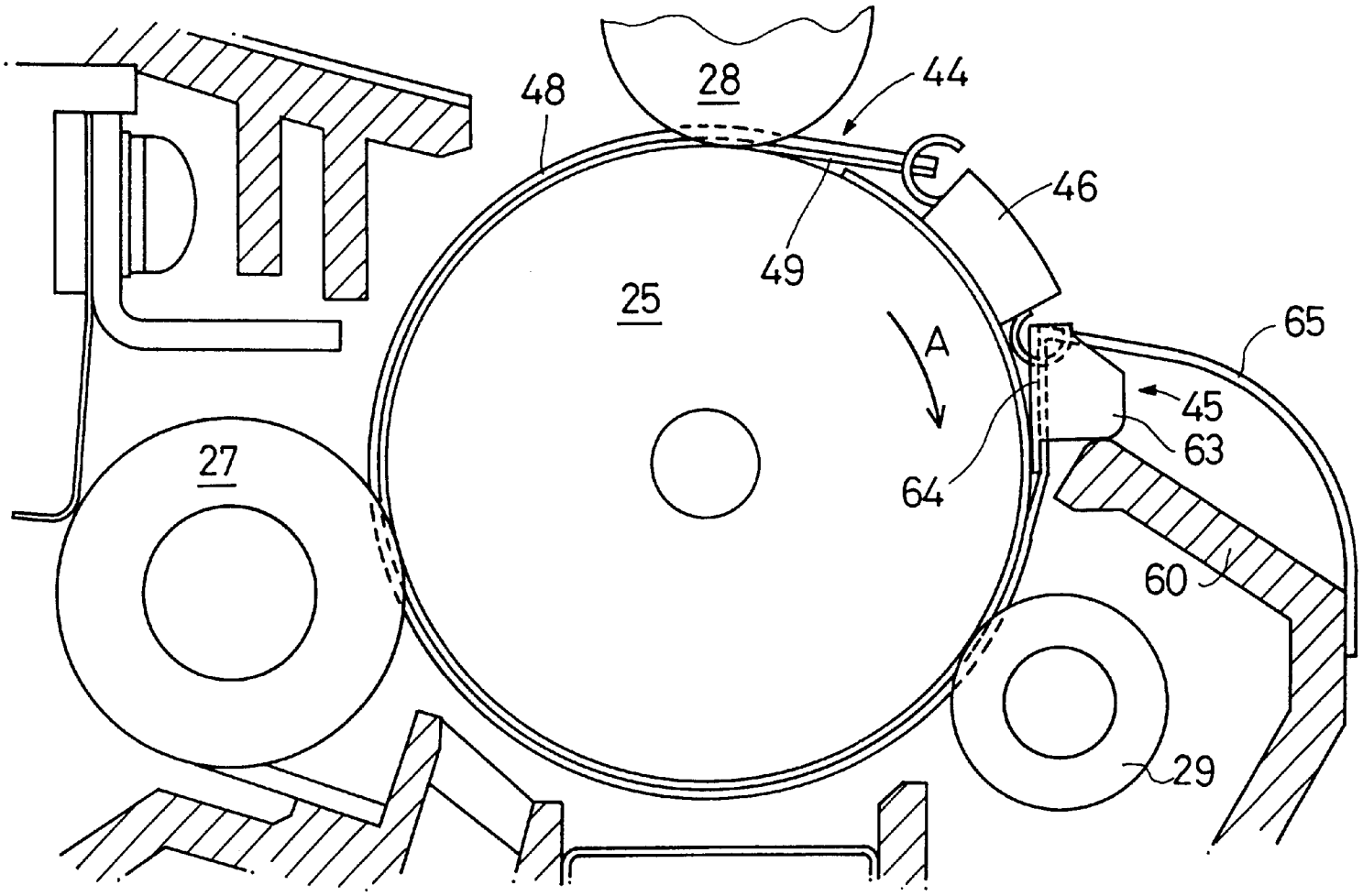
FIG. 5 is an enlarged sectional side view of the photosensitive drum during printing in the first embodiment.

The release belt 44 that forms the first and second concaves in cooperation with the periphery of the photosensitive drum 25 will be described below with reference to FIGS. 4 and 5. FIG. 5 is an enlarged sectional side view of the photosensitive drum 25 during printing.

As shown in FIGS. 4 and 5, each of the pair of release belts 44 has a nip release belt 49 (a first belt) made of synthetic resin such as polyethylene terephthalate (referred to as PET, hereinafter), a roller guide belt 48 (a second belt) made of, as well as the belt 49, synthetic resin such as polyethylene terephthalate, and a stopper 45. The stopper 45 is constructed of a flat base 64 made of a thin steel plate and the like and a pair of bent portions 63 formed by bending both widthwise ends at a right angle. In the flat base 64, a spring hole (not shown) is formed.

In the nip release belt 49, at a predetermined position thereof, a nip hole 62 (a first through hole) is formed having a width substantially equal to the width of pitch roller 47. In an end of the nip release belt 49 on an end side in a reverse rotating direction, which is above the other end side in the regular rotating direction in FIG. 5, a spring hole (not shown) is formed, through which a hook of the tension spring 46 is to be inserted.

In the roller guide belt 48, at a position opposite to the nip hole 62, a roller guide hole 61 (a second through hole) is formed in a substantial quadrilateral having a width substantially equal to that of the nip hole 62 and a length longer than that of same. An end portion of the roller guide belt 48 extends by a predetermined length than the nip release belt 49 to form a back stop 65 as shown in FIG. 5. In an end of the roller guide belt 48 in the reverse rotating direction side, a spring hole (not shown) is formed in correspondence with the spring hole of the nip release belt 49. The roller guide belt 48 is also provided with another spring hole at a portion where the flat base 64 of the stopper 45 is adhered with a double-sided adhesive tape or an adhesive.

The roller guide belt 48 is superposed on the nip release belt 49 so that a side of the nip hole 62, vertical to a lengthwise direction thereof, is opposite to a side of the roller guide hole 61, vertical to a lengthwise direction thereof, on the reverse rotation side. The roller guide belt 48 is adhered on the nip release belt 49 with an adhesive or a double-sided adhesive tape by the length from the end of the belt 49 on the reverse rotation side to the position before the tension spring 46 on the regular rotation side. Under the end of the roller guide belt 48 adhered on the nip release belt 49 before the tension spring 46, the flat base 64 of the stopper 45 is adhered to the roller guide belt 48 with an adhesive with the bent portions 63 positioned outward (see FIG. 5).

The release belt 44 constructed as above is wound around the photosensitive drum 25 at each end thereof opposite to the pitch roller 47 so that the stopper 45 is located near the casing 60 and the nip release belt 49 is inside the roller guide belt 48, and is engaged with the tension spring 46. The end portion of the back stop 65 of the release belt 44 is adhered at a predetermined of the casing 60 with an adhesive and the like. Accordingly, the nip hole 62 forms a first concave section in cooperation of the external periphery of the photosensitive drum 25. The roller guide hole 61 forms a second concave section in cooperation with the surface of the nip release belt 49.

Figure 6:
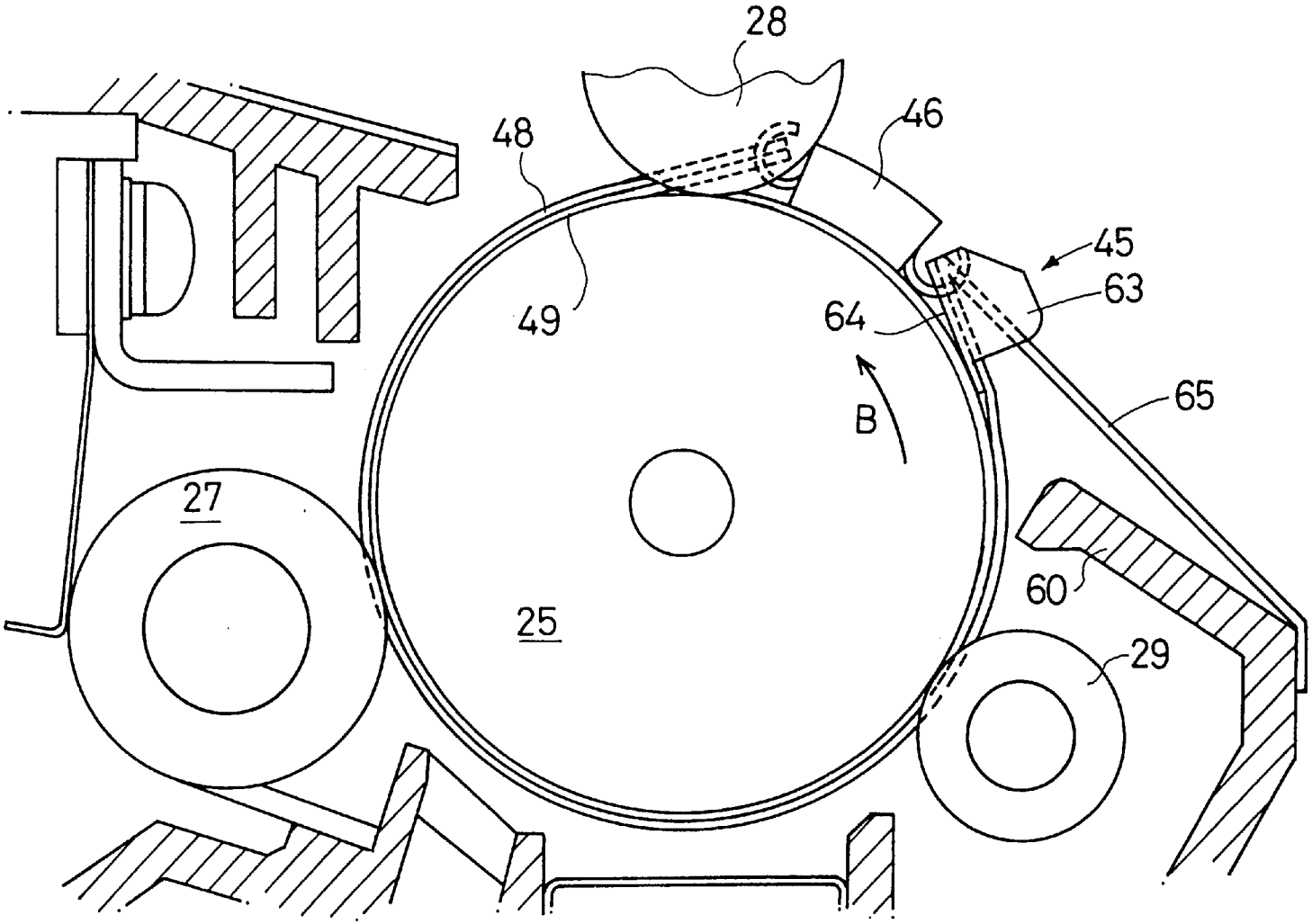
FIG. 6 is an enlarged sectional side view of the photosensitive drum after completion of printing in the first embodiment.

Next, explanation is made on a mechanism for a contact or release operation between the photosensitive drum 25 and the developing roller 27 by means of a switching device provided with the release belt 44 and the pitch roller 47, referring to FIGS. 5 and 6. FIG. 6 is an enlarged sectional side view of the photosensitive drum 25 after completion of printing.

First, during printing, the photosensitive drum 25 is driven by the motor 55 for photosensitive drum to rotate in a direction indicted by an arrow A (clockwise in FIG. 5). The rotation of the drum 25 causes the release belt 44 to rotate in the same direction due to surface friction between the nip release belt 49 and the photosensitive drum 25 until the bent portions 63 of the stopper 45 come into contact with the casing 60 as shown in FIG. 5. The rotation of the release belt 44 in the direction of the arrow A is thus stopped. The photosensitive drum 25 is allowed to subsequently rotate in the arrow A direction while sliding against the nip release belt 49, so that the stopper 45 of the release belt 44 is held against the casing 60, with the back stop 65 of the roller guide belt 48 remained in a curve. At this time, the pitch roller 47 is rotated in an opposite direction (counterclockwise in FIG. 5) to the rotation of the photosensitive drum 25 and eventually becomes engaged to the roller guide hole 61 and the nip hole 62 of the release belt 44. The developing roller 27 is driven by the motor 56 for developing roller to rotate in the same direction as that of the photosensitive drum 25, i.e., clockwise in FIG. 5, as made contact under pressure with the photosensitive drum 25 by a compressive spring 43 through a swing arm 41.

Upon completion of printing, the motor 56 is de-energized to stop the developing roller 27. The motor 55 causes the photosensitive drum 25 to rotate by a predetermined angle (about 25° to 30° in the first embodiment) in the direction indicated by an arrow B (counterclockwise in FIG. 6). The release belt 44 is rotated in the same direction due to surface friction between the nip release belt 49 and the photosensitive drum 25, so that the back stop 65 held in a curve is pulled straight as shown in FIG. 6, thus preventing the more rotation of the release belt 44 in the arrow B direction (counterclockwise in FIG. 6). Simultaneously, friction torque acts so as to pull the tension spring 46, which causes the release belt 44 to come loose. Thus, the photosensitive drum 25 is rotated by small reverse torque. The pitch roller 47 is rotated in an opposite direction (clockwise in FIG. 6) to the rotating direction of the photosensitive drum 25 and guided along the roller guide hole 61 of the release belt 44, and eventually runs onto the upper plane of the nip release belt 49. This provides a clearance substantially equal to the thickness of the nip release belt 49 between the developing roller 27 and the photosensitive drum 25, as shown in FIGS. 4 and 6. In this manner, the developing roller 27 is surely separated from the photosensitive drum 25.

As described above in detail, the laser printer 1 in the first embodiment is arranged so that the pitch roller 47 is engaged in the roller guide hole 61 and the nip hole 62 of the release belt 44 during the regular rotation, or the rotation in the first direction, of the photosensitive drum 25 in a printing operation to allow the developing roller 27 to be in contact under pressure with the photo sensitive drum 25. Alternatively,the reverse rotation, or the rotation in the second direction, of the photosensitive drum 25 by a predetermined angle causes the pitch roller 47 to rotate along the roller guide hole 61 to run onto the nip release belt 49. When the pitch roller 47 comes to the upper plane of the nip release belt 49, the developing roller 27 is separated from the photosensitive drum 25 by a clearance substantially equal to the thickness of the nip release belt 49.

Accordingly, the reverse rotation of the photosensitive drum 25 by a predetermined angle can prevent the generation of drum stains, and provide a high printing quality for a long period. The developing roller 27 can be separated from the photosensitive drum 25 without needing the reverse rotation thereof. Also, the laser printer 1 in the embodiment needs no mechanisms for preventing the toner leakage or the rising of the process unit 7 and others, and can prevent the generation of drum stains with a simple and inexpensive mechanism, resulting in a reduced manufacturing cost.

Furthermore, as made of a thin steel plate and the like, the stopper 45 can be manufactured by a simple press molding operation at reduced material cost or manufacturing cost.

The pitch roller 47 being engaged in the guide hole 61 can prevent the release belt 44 from winding and prevent disengagement of the pitch roller 47 from the release belt 44 due to oscillation in transportation.

With the stopper 45 adhered to the release belt 44, the release belt 44 can be held at a predetermined angle during the regular rotation of the photosensitive drum 25. On the other hand, with the back stop 65 of the roller guide belt 48, an end of which is fixed at a predetermined position of the casing 60, the release belt 44 can be stopped at a predetermined angle during the reverse rotation of the photosensitive drum 25. The release belt 44 can also be made loose at one end thereof during the reverse rotation of the drum 25, which reduce the reverse torque of the drum 25, thereby preventing the process unit 7 and the like from rising from a proper position. Furthermore, an end portion of the roller guide belt 48 is extended forming the back stop 65, so that the number of components and manufacturing steps can be decreased, resulting in the reduction in cost.

Next, a laser printer in the second embodiment according to the present invention will be described. This laser printer has substantially the same structure as that in the first embodiment. Like components are given the same numbers as in the first embodiment. The second embodiment differs from the first embodiment in that, instead of the release belt 44 and the pitch roller 47, a pitch cam having a spring clutch for a one-way power transmission is mounted on each end of the developing roller 27 so that the pitch cam in cooperation of the photosensitive drum 25 causes the developing roller 27 to be separated from the photosensitive drum 25 after completion of printing. The circumferential surface of the photosensitive drum 25 opposite to the pit cam which corresponds to a cam member.

Figure 7:
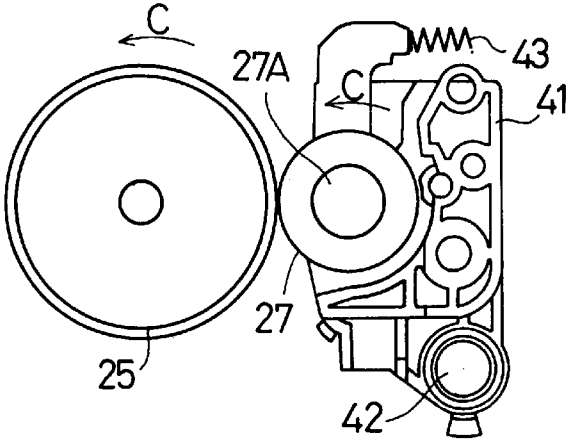
FIG. 7(*a*) is an enlarged sectional partial view showing a sliding contact state of the pitch cam with respect to the photosensitive drum during printing.
Figure 7:
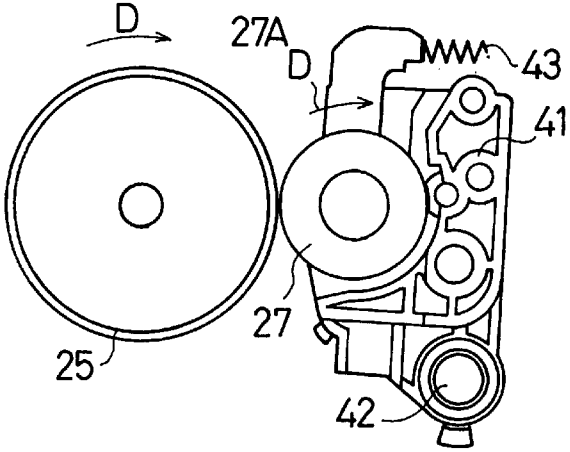
Figure 7:
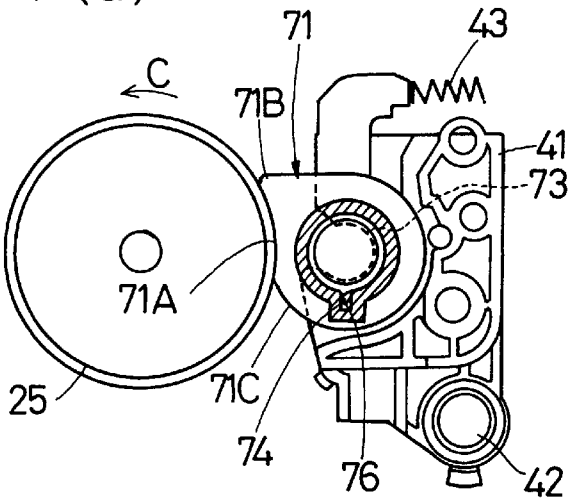
Figure 7:
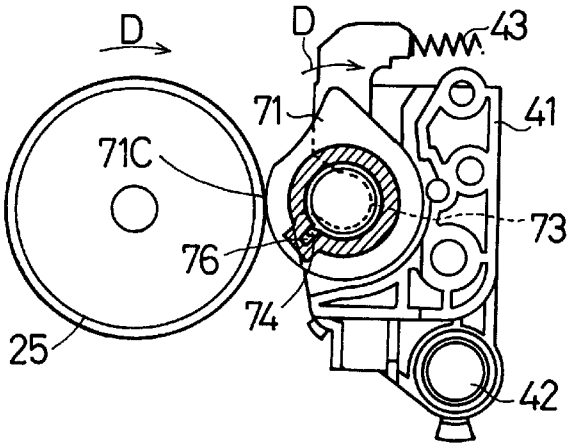
Figure 8:
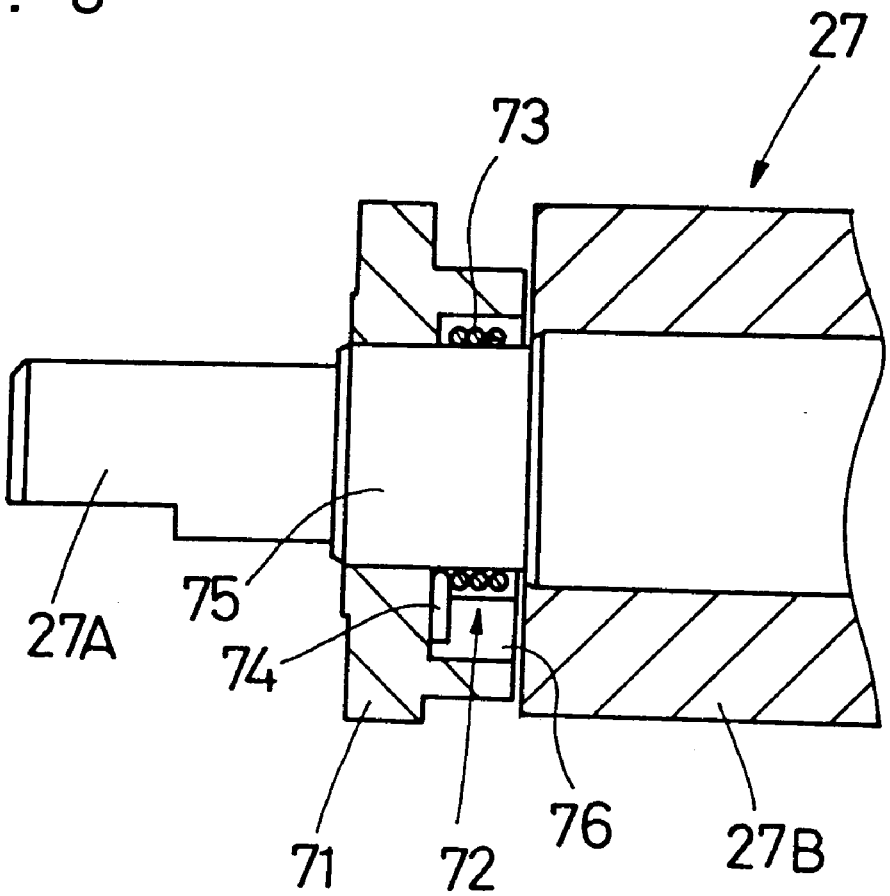
FIG. 8 is an enlarged sectional partial view of a developing roller having a pitch cam thereon in the second embodiment.

Explanation is made on a mechanism for a contact or release operation between the photosensitive drum 25 and the developing roller 27 by means of the pitch cam, referring to FIGS. 7 and 8. FIG. 7 shows a positional relationship between a photosensitive drum and a pitch cam or a developing roller during printing or non-printing in the second embodiment. More specifically, FIG. 7(*a*) is an enlarged sectional partial view showing a sliding contact state of the pitch cam with respect to the photosensitive drum during printing; FIG. 7(*b*) is an enlarged sectional partial view showing a rotating state of both the photosensitive drum and the developing roller during printing; FIG. 7(*c*) is an enlarged sectional partial view showing a reverse rotating state of the photosensitive drum and the pitch cam after completion of printing; FIG. 7(*d*) is an enlarged sectional partial view showing a release state of the developing roller from the photosensitive drum after completion of printing. FIG. 8 is an enlarged sectional partial view of the developing roller having the pitch cam thereon in the second embodiment.

As shown in FIG. 7(*a*), first, a pitch cam 71 has a sliding contact portion 71A (a small diameter portion) that comes into slidably contact with the circumferential surface of the photosensitive drum 25 during printing, a stopper portion 71B, and a contact portion 71C (a large diameter portion) that comes into contact with the photosensitive drum 25 if the pitch cam 71 is reversely rotated after completion of printing.

This contact portion 71C is formed having a circumferential surface with a larger radius than that of the conductive rubber member 27B of the developing roller 27. The radius of curvature of a curved surface forming the sliding contact portion 71A is equal to that of the external circumferential surface of the photosensitive drum 25. The curbed surface is designed so as to have the minimum distance from the center of the roller shaft 27A becomes a little smaller than the radius of the conductive rubber member 27B of the developing roller 27. The stopper portion 71B is formed with a radius larger than that of the contact portion 71C. The pitch cam 71 is provided with a through hole in its longitudinal direction, in which the roller shaft 27A of the developing roller 27 is inserted. In the through hole, at a predetermined position, a groove 76 is formed to receive an extended end 74 of a coil spring clutch 72 (see FIG. 8).

This spring clutch 72 is described hereinafter with reference to FIG. 8. It has a coil portion 73 having a slightly smaller inner diameter than an outer diameter of a step portion 75 of the roller shaft 27A, on which the pitch cam is mounted. The coil portion 73 is wound clockwise if seen from the left side in FIG. 8 and has the extended end 74 extending by a predetermined length from the coil portion at a left end thereof in FIG. 8. The spring clutch 72 is inserted in the pitch cam 71 with the extended end 74 inserted in the groove 76 formed in the pitch cam 71. The coil portion 73 is fitted on the step portion 75 with an inner diameter of the coil portion 73 widened against its elasticity. With the extended end 74 inserted in the groove 76, the coil portion 73 is interlocked with the pitch cam 71 to rotate together.

Accordingly, the roller shaft 27A is rotated in slidably contact with the inner surface of the coil portion 73. When the developing roller 27 is rotated in a direction (the direction indicated by an arrow C in FIG. 7) opposite to the winding direction of the coil portion 73, widening the coil portion 73, the rotation of this developing roller 27 is transmitted to the spring clutch 72 under a small load, while it is not transmitted to the spring clutch 72 when a predetermined load is applied thereto, thus stopping the rotation of the pitch cam 71 regardless of the rotation of the roller shaft 27A. The roller shaft 27A is allowed to freely rotate in the direction C. When the developing roller 27 is rotated in the same direction as the winding direction of the coil portion 73, i.e., in a direction indicated by an arrow D in FIG. 7, the coil portion 73 is tightened, so that the rotation of the roller shaft 27A is transmitted to the spring clutch 72 to allow the pitch cam 71 to rotate in the direction D along with the rotation of the roller shaft 27A.

As shown in FIG. 8, the pitch cam 71 is fitted on each of the step portions 75 formed at both ends of the roller shaft 27A, through the spring clutch 72 for one-way power transmission.

A mechanism for a contact or release operation between the photosensitive drum 25 and the developing roller 27 by means of the pitch cam 71 acting as a switching device is described below, referring to FIG. 7.

As shown in FIGS. 7(*a*) and 7(*b*), during printing, the photosensitive drum 25 is driven by the motor 55 to rotate in the direction C (counterclockwise in FIG. 7) and the developing roller 27 is driven by the motor 56 to rotate in the same direction. In this state, the rotation of the roller shaft 27A, though it acts on the coil portion 73 to widen it, is transmitted to the pitch cam 71 through the spring clutch 72 under a small load. The pitch cam 71 is rotated along with the developing roller 27. When the stopper portion 71B comes to contact with the photosensitive drum 25, the pitch cam 71 is stopped to rotate, thereby applying a predetermined load to the spring clutch 72. Therefore, the rotation of the roller shaft 27A is not transmitted to the spring clutch 72 and the sliding contact portion 71A is in slidably contact with the circumferential surface of the photosensitive drum 25 as shown in FIG. 7(*a*). Since the minimum distance between the curved surface of the sliding contact portion 71A and the center of the roller shaft 27A is designed to be a little smaller than the radius of the conductive rubber member 27B of the developing roller 27, the developing roller 27 is rotated by the motor 56 in the same direction as the rotating direction of the photosensitive drum 25 (counterclockwise in FIG. 7(*b*)) while it is in contact under pressure with the photosensitive drum 25 with the compressive spring 43 through the swing arm 41.

On the other hand, after completion of printing, the photosensitive drum 25 is driven by the motor 55 to rotate by a predetermined angle in the direction D (clockwise in FIG. 7) and the developing roller 27 is driven by the motor 56 to rotate by a predetermined angle in the same direction. In this state, the rotation of the roller shaft 27A, acting on the coil portion 73 to tighten it, is transmitted to the pitch cam 71 through the spring clutch 72 to rotate the pitch cam 71 by a predetermined angle (from the position shown in FIG. 7(*a*) to the position shown in FIG. 7(*c*)) in the direction D. In this state of the pitch cam 71, the photosensitive drum 25 runs onto the contact portion 71C as shown in FIG. 7(*c*). This contact portion 71C is held as in contact under pressure with the photosensitive drum 25 by the compressive spring 43 through the swing arm 41. Here, the contact portion 71C having the circumferential surface with a larger radius than that of the conductive rubber member 27B of the developing roller 27, the contact portion 71C provides, between the developing roller 27 and the photosensitive drum 25, a clearance having the distance substantially equal to a difference in size of radius between the circumferential surface of the contact portion 71 and the conductive rubber member 27B. Accordingly, the developing roller 27 can surely be released from the photosensitive drum 25 as shown in FIG. 7(*d*).

As mentioned above in detail, in the laser printer 1 in the second embodiment, when the photosensitive drum 25 and the developing roller 27 are rotated in a regular direction (in the direction C in FIGS. 7(*a*) and 7(*b*)) during printing, the stopper portion 71B of the pitch cam 71 is in contact with the photosensitive drum 25 and the sliding contact portion 71A is in slidably contact with the surface of the photosensitive drum 25, allowing the developing roller 27 to be in contact under pressure with the surface of the photosensitive drum 25.

Since the photosensitive drum 25 and the developing roller 27 are reversely rotated (in the direction D in FIGS. 7(*c*) and 7(*d*)) by a predetermined angle upon completion of printing, the photosensitive drum 25 is allowed to run onto the contact portion 71C to ensure the release of the developing roller 27 from the photosensitive drum 25.

In this manner, the reverse rotation of the photosensitive drum 25 and the developing roller 27 by a predetermined angle can cause the separation therebetween, so that the generation of drum stains can be prevented to provide a high printing quality for a long period. The apparatus can also prevent the occurrence of drum stains by a simple and inexpensive mechanism and achieve a reduction in manufacturing cost and also a compact apparatus.

Using the spring clutch 72, a one-way power transmission clutch can be formed with a simple and inexpensive mechanism. This can reduce the manufacturing cost and achieve a compact apparatus.

Furthermore, if the contact portion 71C having a larger radius than that of the developing roller 27 is formed into the circumferential surface which can be easily processed, the manufacturing cost can be reduced. With this contact portion 71C, the clearance between the photosensitive drum 25 and the developing roller 27 can be held constantly.

Next, a laser printer in the third embodiment will be described. This laser printer has substantially the same structure as that in the second embodiment. Like components are given the same numbers as in the second embodiment. The features in the third embodiment different from the second embodiment are in that, to separate the developing roller 27 from the photosensitive drum 25 upon completion of printing, only the developing roller 27 is rotated in the direction D, i.e., clockwise in FIG. 9, by a predetermined angle.

Figure 9:
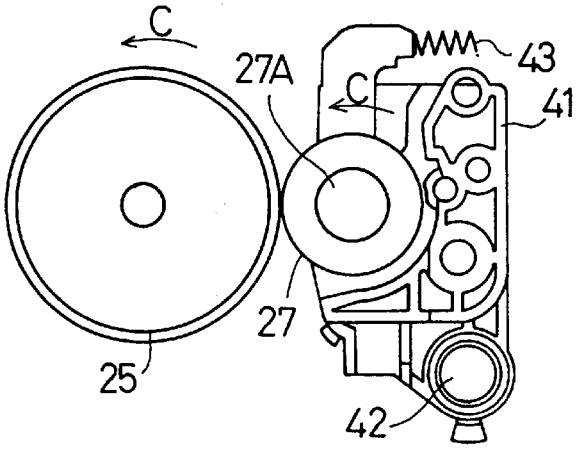
FIG. 9(*a*) is an enlarged sectional partial view showing a sliding contact state of the pitch cam with respect to the photosensitive drum during printing.
Figure 9:
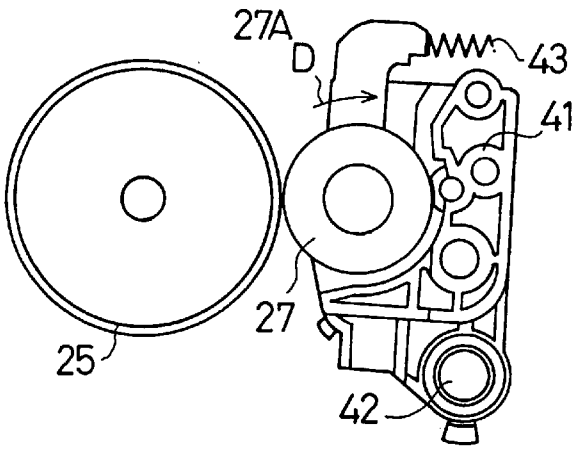
Figure 9:
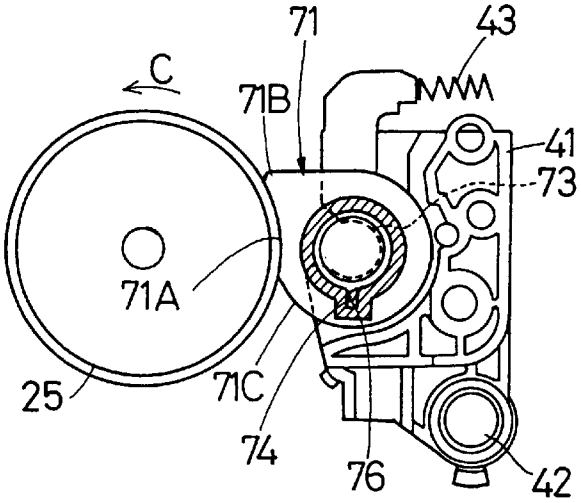
Figure 9:
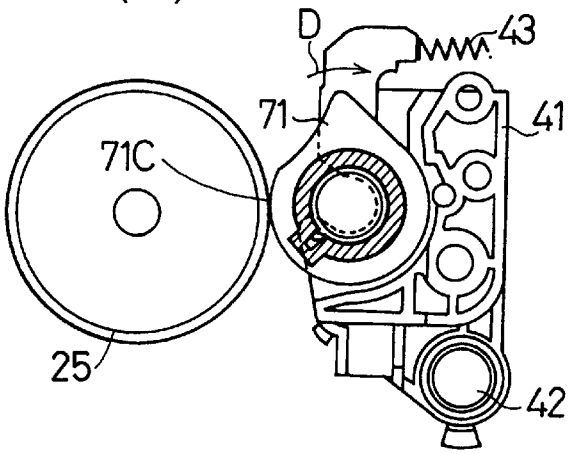
Figure 10A:
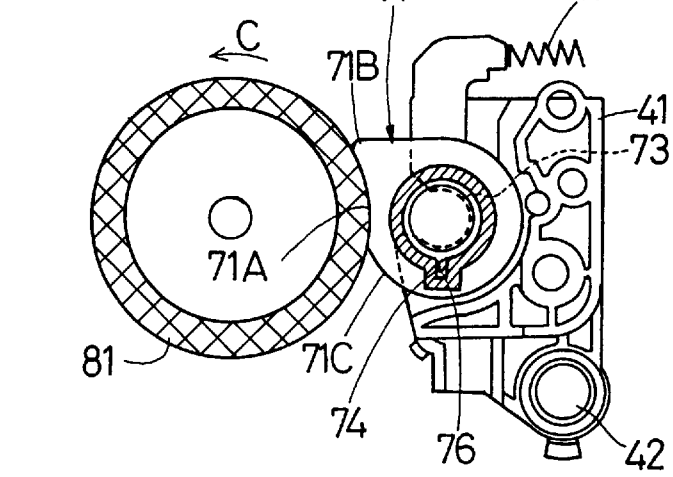
FIG. 10(*a*) is an enlarged sectional partial view showing a sliding contact state of the pitch cam with respect to the sliding contact member during printing.
Figure 10B:
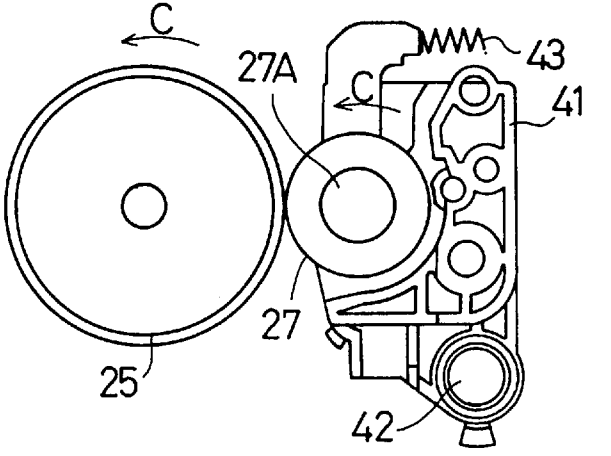
Figure 10C:
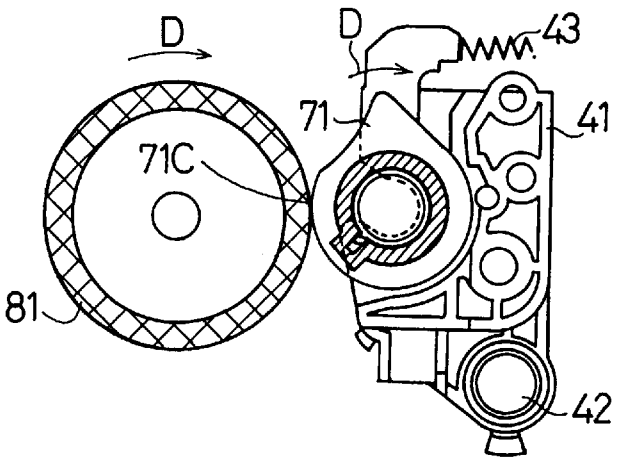
Figure 10D:
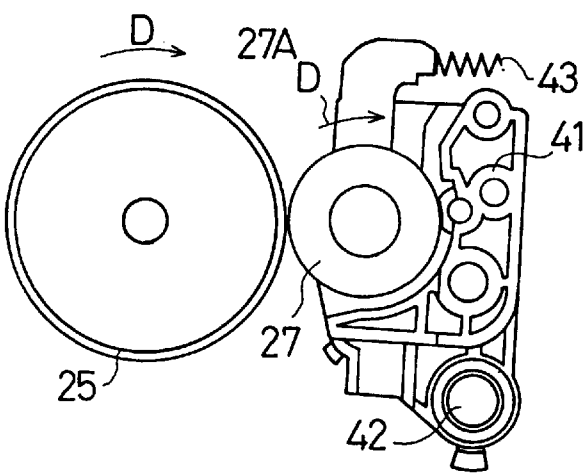

A mechanism for a contact or release operation between the photosensitive drum 25 and the developing roller 27 by means of the pitch cam 71 acting as a switching device is described below, referring to FIG. 9. FIG. 9 shows a positional relationship between the photosensitive drum and the pitch cam or the developing roller during printing or after completion of printing. More specifically, FIG. 9(*a*) is an enlarged sectional partial view showing a sliding contact state of the pitch cam with respect to the photosensitive drum during printing; FIG. 9(*b*) is an enlarged sectional partial view showing a rotating state of both a photosensitive drum and a developing roller during printing; FIG. 9(*c*) is an enlarged sectional partial view showing a reversely rotating state of the pitch cam after completion of printing; FIG. 9(*d*) is an enlarged sectional partial view showing a released state of the developing roller from the photosensitive drum after completion of printing.

As shown in FIGS. 9(*a*) and 9(*b*), during printing, the photosensitive drum 25 is driven by the motor 55 to rotate in the direction C (counterclockwise in FIG. 9) and the developing roller 27 is driven by the motor 56 to rotate in the same direction. In this state, the rotation of the roller shaft 27A, though it acts on the coil portion 73 to widen it, is transmitted to the pitch cam 71 through the spring clutch 72 under a small load. The pitch cam 71 is rotated along with the developing roller 27. When the stopper portion 71B comes to contact with the photosensitive drum 25, the pitch cam 71 is stopped to rotate, thereby applying a predetermined load to the spring clutch 72. Therefore, the rotation of the roller shaft 27A is not transmitted to the spring clutch 72 and the sliding contact portion 71A is in slidably contact with the circumferential surface of the photosensitive drum 25 as shown in FIG. 9(*a*). Since the minimum distance between the curved surface of the sliding contact portion 71A and the center of the roller shaft 27A is designed to be a little smaller than the radius of the conductive rubber member 27B of the developing roller 27, as well as in the second embodiment, the developing roller 27 is rotated by the motor 56 in the same direction as the rotating direction of the photosensitive drum 25 (counterclockwise in FIG. 9(*b*)) while it is in contact under pressure with the photosensitive drum 25 with the compressive spring 43 through the swing arm 41, which corresponds to a supporting means.

On the other hand, after completion of printing, the photosensitive drum 25 is stopped, while the developing roller 27 is driven by the motor 56 to rotate by a predetermined angle in the direction D (clockwise in FIG. 9). In this state, the rotation of the roller shaft 27A, acting on the coil portion 73 to tighten it, is transmitted to the pitch cam 71 through the spring clutch 72 to rotate the pitch cam 71 by a predetermined angle (from the position shown in FIG. 9(*a*) to the position in FIG. 9(*c*)) in the direction D. In this state of the pitch cam 71, the photosensitive drum 25 runs onto the contact portion 71C as shown in FIG. 9(*c*). This contact portion 71C is held as contact under pressure with the photosensitive drum 25 by the compressive spring 43 through the swing arm 41. Here, the contact portion 71C having the circumferential surface with a larger radius than that of the conductive rubber member 27B of the developing roller 27, the contact portion 71C provides a clearance having the distance substantially equal to a difference in size of radius between the circumferential surface of the contact portion 71 and the conductive rubber member 27B, between the developing roller 27 and the photosensitive drum 25.

Accordingly, the developing roller 27 can surely be released from the photosensitive drum 25 as shown in FIG. 9(*d*).

As mentioned above in detail, in the laser printer 1 in the third embodiment, when the photosensitive drum 25 and the developing roller 27 are rotated in a regular direction (in the direction C in FIGS. 9(*a*) and 9(*b*)) during printing, the stopper portion 71B of the pitch cam 71 is in contact with the photosensitive drum 25 and the sliding contact portion 71A is in slidably contact with the surface of the photosensitive drum 25, allowing the developing roller 27 to be in contact under pressure with the surface of the photosensitive drum 25.

Upon completion of printing, the photosensitive drum 25 is stopped and only the developing roller 27 is reversely rotated (in the direction D in FIGS. 9(*c*) and 9(*d*)) by a predetermined angle, so that the photosensitive drum 25 is allowed to run onto the contact portion 71C to ensure the release of the developing roller 27 from the photosensitive drum 25.

In this manner, the reverse rotation of only the developing roller 71 by a predetermined angle, while the photosensitive drum 25 is stopped, can cause the developing roller 27 to separate from the photosensitive drum 25, thus preventing the generation of drum stains and providing a high printing quality for a long period. The apparatus can also prevents the occurrence of drum stains by a simple and inexpensive mechanism, achieving a reduction in manufacturing cost and further a compact apparatus.

Using the spring clutch 72, a one-way power transmission clutch can be formed with a simple and inexpensive mechanism. This can reduce the manufacturing cost and achieve a compact apparatus.

Since the release of the developing roller 27 from the photosensitive drum 25 after completion of printing is made by the reverse rotation of only the developing roller 27, a control circuit for the release becomes simple to achieve a reduction in manufacturing cost and a compact apparatus.

Furthermore, if the contact portion 71C having a larger radius than that of the developing roller 27 is formed into the circumferential surface which can be easily processed, the manufacturing cost can be reduced. With this contact portion 71C, the clearance between the photosensitive drum 25 and the developing roller 27 can be held constantly.

Next, a laser printer in the fourth embodiment according to the present invention will be described. This laser printer has the substantially same structure as that in the second embodiment. Like components are given the same numbers as in the second embodiment. The features in the fourth embodiment different from the second embodiment are in that, the photosensitive drum 25 is provided at each end thereof with a sliding contact member 81 made of synthetic resin such as urethane resin, arranged opposite to each of the pitch cam 71. The sliding contact member 81 has an outer diameter substantially equal to that of the photosensitive drum 25.

A mechanism for a contact or release operation between the photosensitive drum 25 and the developing roller 27 by means of the pitch cam, referring to FIG. 10. More specifically, FIG. 10(*a*) is an enlarged sectional partial view showing a sliding contact state of the pitch cam with respect to the sliding contact member during printing; FIG. 10(*b*) is an enlarged sectional partial view showing a rotating state of both the photosensitive drum and the developing roller during printing; FIG. 10(*c*) is an enlarged sectional partial view showing a reverse rotating state of the sliding contact member and the pitch cam after completion of printing; FIG. 10(*d*) is an enlarged sectional partial view showing a release state of the developing roller from the photosensitive drum after completion of printing.

As shown in FIG. 10(*a*), first, the sliding contact member 81 is fitted on each end of the photosensitive drum 25, opposite to the pitch cam 71. As shown in FIGS. 10(*a*) and 10(*b*), during printing, the photosensitive drum 25 is driven by the motor 55 to rotate in the direction C (counterclockwise in FIG. 10) and the sliding contact member 81 is also rotated integrally with the photosensitive drum 25 in the same direction. The developing roller 27 is driven by the motor 56 to rotate in the same direction. In this state, the rotation of the roller shaft 27A, though it acts on the coil portion 73 to widen it, is transmitted to the pitch cam 71 through the spring clutch 72 under a small load. The pitch cam 71 is rotated along with the developing roller 27. When the stopper portion 71B comes to contact with the sliding contact member 81 of the photosensitive drum 25, the pitch cam 71 is stopped to rotate, thereby applying a predetermined load to the spring clutch 72. Therefore, the rotation of the roller shaft 27A is not transmitted to the spring clutch 72 and the sliding contact portion 71A is in slidably contact with the sliding contact member 81 as shown in FIG. 10(*a*). Since the minimum distance between the curved surface of the sliding contact portion 71A and the center of the roller shaft 27A is designed to be a little smaller than the radius of the conductive rubber member 27B of the developing roller 27, as well as in the second embodiment, the developing roller 27 is rotated by the motor 56 in the same direction as the rotating direction of the photosensitive drum 25 (counterclockwise in FIG. 10(*b*)) while it is in contact under pressure with the photosensitive drum 25 with the compressive spring 43 through the swing arm 41.

On the other hand, after completion of printing, the photosensitive drum 25 is driven by the motor 55 to rotate by a predetermined angle in the direction D (clockwise in FIG. 10) and the developing roller 27 is driven by the motor 56 to rotate by a predetermined angle in the same direction. In this state, the rotation of the roller shaft 27A, acting on the coil portion 73 to tighten it, is transmitted to the pitch cam 71 through the spring clutch 72 to rotate the pitch cam 71 by a predetermined angle (from the position shown in FIG. 10(*a*) to the position in FIG. 10(*c*)) in the direction D. In this state of the pitch cam 71, the sliding contact member 81 runs onto the contact portion 71C as shown in FIG. 7(*c*). This contact portion 71C is held as in contact under pressure with the sliding contact member 81 by the compressive spring 43 through the swing arm 41. Here, the sliding contact member 81 having the circumferential surface with a radius substantially equal to that of the photosensitive drum 25 and the contact portion 71C having the circumferential surface with a larger radius than that of the conductive rubber member 27B of the developing roller 27, the contact portion 71C provides a clearance having the distance substantially equal to a difference in size of radius between the circumferential surface of the contact portion 71 and the conductive rubber member 27B, between the developing roller 27 and the photosensitive drum 25. Accordingly, the developing roller 27 can surely be released from the photosensitive drum 25 as shown in FIG. 10(*d*).

As mentioned above in detail, in the laser printer 1 in the fourth embodiment, when the photosensitive drum 25, the sliding contact member 81, and the developing roller 27 are rotated in a regular direction (in the direction C in FIGS. 10(*a*) and 10(*b*)) during printing, the stopper portion 71B of the pitch cam 71 is in contact with the sliding contact member 81 and the sliding contact portion 71A is in slidably contact with the surface of the sliding contact member 81, allowing the developing roller 27 to be in contact under pressure with the surface of the photosensitive drum 25.

Upon completion of printing, the photosensitive drum 25 with the sliding contact member 81 and the developing roller 27 are reversely rotated (in the direction D in FIGS. 10(*c*) and 10(*d*)) by a predetermined angle, so that the sliding contact member 81 is allowed to run onto the contact portion 71C to ensure the release of the developing roller 27 from the photosensitive drum 25.

In this manner, the reverse rotation of the photosensitive drum 25 and the developing roller 71 by a predetermined angle can cause the developing roller 27 to separate from the photosensitive drum 25, thus preventing the generation of drum stains and providing a high printing quality for a long period. The apparatus can also prevents the occurrence of drum stains by a simple and inexpensive mechanism, achieving a reduction in manufacturing cost and further a compact apparatus. In addition, even for a continuous long stop period of printing, the pitch cam 71 does not touch the photosensitive drum 25, though touching the sliding contact member 81, the photosensitive drum 25 can be prevented from being subjected to the drum stains. Accordingly, the laser printer in the present embodiment can provide a high printing quality for a long time.

Using the spring clutch 72, a one-way power transmission clutch can be formed with a simple and inexpensive mechanism. This can reduce the manufacturing cost and achieve a compact apparatus.

Furthermore, the contact portion 71C of the pitch cam 71 being formed with a circumferential surface having a larger radius than that of the developing roller 27, and the sliding member 81 being formed with a circumferential surface having a radius substantially equal to that of the photosensitive drum 25, if the contact portion 71C and the sliding contact portion 81 are formed into the circumferential surfaces which can be easily processed, the manufacturing cost can be reduced and the clearance between the photosensitive drum 25 and the developing roller 27 can be held constantly.

The present invention may be embodied in other specific forms without departing from the spirit or essential characteristics thereof. For instance, although the back stop 65 of the roller guide belt 48 is fixed on the casing 60 to limit the rotation angle of reverse rotation of the release belt 44, it may be arranged that the stopper 45 comes into contact with the casing or others as the photosensitive drum 25 is rotated by a predetermined angle to limit the angle of the reverse rotation of the release belt 44, where the back-stop 65 is not used.

The angle of the reverse rotation of the release belt 44 may also be controlled by the precise control of the reverse rotation angle of the photosensitive drum.

The release belt 44, though wound in tension by the tension spring 46 in the first embodiment, may be wound by an elastic member such as rubber.

The release belt 44 may be formed partially with a small width, though it has a uniform width along its whole length in the first embodiment.

The pitch roller 47, though made of synthetic resin in the first embodiment, may be a metal ring provided internally with a bearing and the like.

The stopper 45 is not limited to a thin steel plate described in the above embodiments and may be a production made of synthetic resin such as ABS resin.

The roller guide belt 48 and the nip release belt 49 may be adhered to each other by heat-welding, although they are adhered with a double-sided adhesive tape or an adhesive in the first embodiment.

The sliding contact member 81, though fitted on each end of the photosensitive drum 25 in the fourth embodiment, may be wound round the photosensitive drum 25 opposite to the pitch cam 71.

In the fourth embodiment, the photosensitive drum 25 and the developing roller 27 are reversely rotated at the same time after completion of printing, but it may be arranged so that only the developing roller 27 be reversely rotated while the photosensitive drum 25 be stopped.

In the above embodiments, through the photosensitive drum 25 and the developing roller 27 are driven by the motors individually, they may be driven by a common motor.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus for performing image formation using an electrophotographic process, the apparatus having a cylindrical photosensitive drum on which an electrostatic latent image is to be formed and a developing roller which supplies developer material to the latent image formed on the photosensitive drum to develop it, the developing roller being disposed opposite to the photosensitive drum, the apparatus comprising:

switching means for switching the photosensitive drum and the developing roller from a first position where they are in contact with each other to a second position where they are separated from each other in cooperation with rotation of at least one of the photosensitive drum and the developing roller, after completion of printing, in a second rotating direction which is opposite to a first rotating direction in which at least one of the photosensitive drum and the developing roller is rotated during printing, wherein the switching means comprises first and second operating sections disposed on one of the photosensitive drum and the developing roller, the first operating section operating for positioning the photosensitive drum and the developing roller in the first position in cooperation of another one of the photosensitive drum and the developing roller and the second operating section operating for positioning the same in the second position.

2. An image forming apparatus according to claim 1, further comprising a first positioning part disposed on the photosensitive drum and a second positioning part disposed on the developing roller;

wherein the first and the second operating sections are disposed on one of the first and second positioning parts.

3. An image forming apparatus according to claim 2, wherein the first positioning part is arranged opposite to the second positioning part, the photosensitive drum and the developing roller are supported in the first position when the first and second positioning parts are opposite to each other through the first operating section, and the photosensitive drum and the developing roller are supported in the second position when the first and second positioning parts are opposite to each other through the second operating section.

4. An image forming apparatus according to claim 3, further comprising:

first driving means for driving the photosensitive drum to rotate;

second driving means for driving the developing roller to rotate; and supporting means for supporting the photosensitive drum and the developing roller in the first position so that the first and second positioning parts are made opposite to each other through the first operating section when the photosensitive drum and the developing roller are rotated in the first rotating direction by the first and second driving means.

5. An image forming apparatus according to claim 4, wherein the first and second positioning parts become positioned opposite to each other through the second operating section by rotation of the photosensitive drum in the second rotating direction by the first driving means to thereby position the photosensitive drum and the developing roller in the second position.

6. An image forming apparatus according to claim 5, wherein the second positioning part comprises a cam member mounted on an end of the developing roller so as to opposite to the photosensitive drum, the cam member having a large diameter portion with a larger diameter than a radius of the developing roller and a small diameter portion with a smaller diameter than the same.

7. An image forming apparatus according to claim 6, wherein the small diameter portion comes to opposite to the photosensitive drum when the developing roller is rotated in the first rotating direction by the second driving means to position the photosensitive drum and the developing roller in the first position, and the large diameter portion comes to opposite to the photosensitive drum when the developing roller is rotated by a predetermined angle in the second rotating direction by the second driving means to position the photosensitive drum and the developing roller in the second position.

8. An image forming apparatus according to claim 7, wherein the cam member further comprises a stopper portion with a larger diameter than that of the large diameter portion, formed adjacent to the small diameter portion, the stopper portion operating for preventing rotation of the cam member regardless of the rotation of the developing roller by coming into contact with the photosensitive drum when the small diameter portion is opposite to the photosensitive drum.

9. An image forming apparatus according to claim 8, further comprises a clutch member for stopping power transmission from being transmitted from the developing roller to the cam member upon stop of the rotation of the cam member by contact of the stopper portion to the photosensitive drum.

10. An image forming apparatus according to claim 9, wherein the clutch member comprises a spring clutch disposed between the cam member and the developing roller.

11. An image forming apparatus according to claim 6, further comprising a sliding member disposed on a circumferential surface of the photosensitive drum opposite to the cam member so that the sliding member is in contact slidably with the cam member while the photosensitive drum is rotated in the first rotating direction by the first driving means.

12. An image forming apparatus according to claim 5, wherein the first and second operating sections are provided in the first positioning part at an end of the photosensitive drum.

13. An image forming apparatus according to claim 12, further comprising a first belt member wound in tension around the end of the photosensitive drum, provided with a first through hole that forms a first groove in cooperation of a surface of the photosensitive drum, the first through hole corresponding to the first operating section, wherein a surface of the first belt member acts as the second operating section.

14. An image forming apparatus according to claim 13, further comprising:

a frame of the apparatus;

a contact member fixedly provided on the frame; and a whirl-stop member that operates in cooperation with the contact member;

wherein the whirl-stop member comes into contact with the contact member when the photosensitive drum is rotated in the first rotating direction by the first driving means.

15. An image forming apparatus according to claim 14, further comprising a rotating member attached on an end of the developing roller for the second positioning part, opposite to the first belt member, wherein the photosensitive drum and the developing roller are brought to the first position when the rotating member becomes engaged in the first groove formed by the first through hole of the first belt member while the whirl-stop member comes into contact with the contact member, and they are brought to the second position when the rotating member comes into contact with the surface of the first belt member by rotation of the photosensitive drum by a predetermined angle in the second rotating direction by the first driving means.

16. An image forming apparatus according to claim 12, further comprising:

a first belt member wound in tension around the end of the photosensitive drum, provided with a first through hole that forms a first groove in cooperation with a surface of the photosensitive drum, the first through hole corresponding to the first operating section; and a second belt member superimposed on the first belt member, provided with a second through hole that is longer than the first through hole so as to include the first through hole and forms a second groove in cooperation with a surface of the first belt member, the second through hole corresponding to the second operating section.

17. An image forming apparatus according to claim 16, further comprising:

a frame of the apparatus;

a contact member fixedly provided on the frame; and a whirl-stop member provided on the second belt member;

wherein the whirl-stop member comes into contact with the contact member when the photosensitive drum is rotated in the first rotating direction by the first driving means.

18. An image forming apparatus according to claim 17, further comprising a rotating member attached on an end of the developing roller for the second positioning part, opposite to the first belt member, wherein the photosensitive drum and the developing roller are brought to the first position when the rotating member becomes engaged in the first groove formed by the first through hole of the first belt member while the whirl-stop member comes into contact with the contact member, and they are brought to the second position when the rotating member comes into contact with the surface of the first belt member within the second groove of the second through hole by rotation of the photosensitive drum by a predetermined angle in the second rotating direction by the first driving means.

19. An image forming apparatus according to claim 18, wherein the rotating member comprises a roller member attached rotatably to the end of the developing roller.

20. An image forming apparatus according to claim 16, wherein the first and second belt members are wound in tension around the end of the photosensitive drum by means of an elastic member.

21. An image forming apparatus according to claim 20, further comprising a flexible back stop member with an end thereof secured on an end of the first belt member or the second belt member and another end secured on the contact member to limit reverse rotation of the first and the second belt members.

22. An image forming apparatus according to claim 21, wherein the back stop member is formed of an end portion of the second belt member extended by a predetermined length.

* * * * *